US007098603B2

(12) United States Patent
Choi

(10) Patent No.: US 7,098,603 B2
(45) Date of Patent: Aug. 29, 2006

(54) METHOD AND APPARATUS FOR DRIVING PLASMA DISPLAY PANEL

(75) Inventor: Hak-Ki Choi, Cheonan-si (KR)

(73) Assignee: Samsung SDI Co., Ltd., Suwon (KR)

( * ) Notice: Subject to any disclaimer, the term of this patent is extended or adjusted under 35 U.S.C. 154(b) by 6 days.

(21) Appl. No.: 10/976,211

(22) Filed: Oct. 29, 2004

(65) Prior Publication Data

US 2005/0093470 A1 May 5, 2005

(30) Foreign Application Priority Data

Oct. 30, 2003 (KR) ..... 10-2003-0076198

(51) Int. Cl.
*G09G 3/10* (2006.01)
*G09G 3/28* (2006.01)

(52) U.S. Cl. ..... 315/169.4; 315/169.1; 315/169.3; 345/60; 345/68

(58) Field of Classification Search ..... 315/169.4, 315/169.1, 169.3; 345/60, 55, 204, 63, 66–68
See application file for complete search history.

(56) References Cited

U.S. PATENT DOCUMENTS

| | | | | |
|---|---|---|---|---|
| 5,541,618 | A | 7/1996 | Shinoda | 345/60 |
| 6,784,859 | B1 * | 8/2004 | Setoguchi et al. | 345/60 |
| 2004/0164930 | A1 * | 8/2004 | Hashimoto et al. | 345/60 |

* cited by examiner

*Primary Examiner*—Tho Phan
*Assistant Examiner*—Chuc Tran
(74) *Attorney, Agent, or Firm*—H.C. Park & Associates, PLC

(57) ABSTRACT

A method and apparatus for driving a plasma display panel in which pairs of sustain electrodes lines respectively including X-electrode lines and Y-electrode lines that are alternately arranged parallel with each other are disposed to be orthogonal to address electrode lines, and discharge cells are defined by intersections between the sustain electrodes and the address electrode lines. In the method, a unit frame as a display period is divided into a plurality of subfields to realize time-division grayscale display, and the individual subfields include a reset period, an address period, and a sustain period. The method includes maintaining the Y-electrode lines at a reference level during the reset period and the sustain period; and addressing the Y-electrode lines by biasing the Y-electrode lines to a first level and simultaneously, sequentially applying a scan signal of the reference level to the Y-electrode lines during the address period.

19 Claims, 13 Drawing Sheets

METHOD AND APPARATUS FOR DRIVING PLASMA DISPLAY PANEL

This application claims priority to and the benefit of Korean Patent Application No. 10-2003-0076198, filed on Oct. 30, 2003, which is hereby incorporated by reference for all purposes as if fully set forth herein.

BACKGROUND OF THE INVENTION

1. Field of the Invention

The present invention relates to a method and apparatus for driving a plasma display panel (PDP), and more particularly, to a method and apparatus for driving a PDP having a simplified scan electrode driving circuitry.

2. Discussion of the Related Art

FIG. 1 is an internal perspective view showing the structure of a typical surface discharge type triode PDP, and FIG. 2 is a cross-sectional view of a single discharge cell of the PDP shown in FIG. 1.

Referring to FIG. 1 and FIG. 2, address electrode lines $A_{R1}$, $A_{G1}$, . . . , $A_{Gm}$, $A_{Bm}$, dielectric layers 11 and 15, Y-electrode lines $Y_1, \ldots, Y_n$, X-electrode lines $X_1, \ldots, X_n$, phosphor layers 16, barrier walls 17, and a protective layer 12, are provided between a front glass substrate 10 and a rear glass substrate 13 of the surface discharge PDP 1.

The address electrode lines $A_{R1}, A_{G1}, \ldots, A_{Gm}, A_{Bm}$ are formed on the front surface of the rear glass substrate 13 in a predetermined pattern. A rear dielectric layer 15 covers the address electrode lines $A_{R1}, A_{G1}, \ldots, A_{Gm}, A_{Bm}$. The barrier walls 17 are formed on the rear dielectric layer 15 in between, and in parallel to, the address electrode lines $A_{R1}$, $A_{G1}, \ldots, A_{Gm}, A_{Bm}$. The barrier walls 17 partition discharge regions of respective discharge cells and prevent cross talk between the discharge cells. The phosphor layers 16 are formed on the rear dielectric layer 15 and on the sides of the barrier walls 17.

The X-electrode lines $X_1, \ldots, X_n$ and the Y-electrode lines $Y_1, \ldots, Y_n$ are formed in pairs on the rear surface of the front glass substrate 10 to be orthogonal to the address electrode lines $A_{R1}$, $A_{G1}$, . . . , $A_{Gm}$, $A_{Bm}$, and their intersections define discharge cells. Each of the X-electrode lines $X_1, \ldots, X_n$ and the Y-electrode lines $Y_1, \ldots, Y_n$ may include a transparent electrode portion $X_{1a}, \ldots, X_{na}$ and $Y_{1a}, \ldots, Y_{na}$ formed of a transparent conductive material, e.g., indium tin oxide (ITO), and a metal electrode portion $X_{1b}, \ldots, X_{nb}$ and $Y_{1b}, \ldots, Y_{nb}$, for increasing conductivity. A front dielectric layer 11 covers the X-electrode lines $X_1$, $X_2, \ldots, X_n$ and the Y-electrode lines $Y_1, Y_2, \ldots, Y_n$. The protective layer 12, which may be formed of a magnesium oxide (MgO) layer, protects the panel 1 against a strong electrical field, and it is deposited on the front dielectric layer 11. A gas for forming plasma is hermetically sealed in a discharge space 14.

U.S. Pat. No. 5,541,618 discloses an address-display separation (ADS) driving is method for a PDP having the structure shown in FIG. 1.

FIG. 3 is a block diagram of a typical driving apparatus 2 for the PDP 1 of FIG. 1. Referring to FIG. 3, the driving apparatus 2 includes an image processor 26, a logic controller 22, an address driver 23, an X-driver 24, and a Y-driver 25. The image processor 26 converts an external analog image signal into an internal image signal, for example, 8-bit red (R) video data, 8-bit green (G) video data, and 8-bit blue (B) video data, a clock signal, a vertical synchronizing signal, and a horizontal synchronizing signal. The logic controller 22 generates drive controlling signals $S_A$, $S_Y$, and $S_X$ in response to the internal image signals from the image processor 26.

The address driver 23 processes the address signal $S_A$ to generate a display data signal and applies the display data signal to the address electrode lines. The X-driver 24 processes the X-drive controlling signal $S_X$ and applies the result to the X-electrode lines. The Y-driver 25 processes the Y-drive controlling signal $S_Y$ and applies the result to the Y-electrode lines.

FIG. 4 is a timing chart showing an ADS method of driving the PDP 1 of FIG. 1. Referring to FIG. 4, to realize time-division grayscale display, a unit frame may be divided into a plurality of subfields $SF_1, \ldots, SF_8$. The individual subfields $SF_1, \ldots, SF_8$ may be further divided into reset periods $R_1, \ldots, R_8$, address periods $A_1, \ldots, A_8$, and sustain periods $S_1, \ldots, S_8$, respectively.

The luminance of the PDP 1 is proportional to a total length of the sustain periods S1, . . . , S8 in a unit frame, which is 255 T (T is a unit of time). A time $2^{n-1}$ is set to a sustain period $S_n$ of an nth subfield $SF_n$. Thus, by appropriately selecting a subfield to display, display of 256 grayscales, including grayscale 0, may be performed.

FIG. 5 is a timing chart showing examples of drive signals applied in unit subfields shown in FIG. 4 to electrode lines of the PDP 1 shown in FIG. 1.

In FIG. 5, reference characters $S_{AR1 \ldots ABm}$ are drive signals applied to address electrode lines ($A_{R1}$, $A_{G1}$, . . . , $A_{Gm}$, $A_{Bm}$ of FIG. 1), $S_{X1 \ldots Xn}$ are drive signals applied to X-electrode lines ($X_1, \ldots, X_n$ of FIG. 1), and $S_{Y1 \ldots Yn}$ are drive signals applied to Y-electrode lines ($Y_1, \ldots, Y_n$ of FIG. 1).

Referring to FIG. 5, a unit subfield SF includes a reset period PR, an address period PA, and a sustain period PS. During the reset period PR, a voltage applied to the X-electrode lines $X_1, \ldots, X_n$ is raised from a ground voltage $V_G$ to a first voltage Ve and simultaneously, a ground voltage $V_G$ is applied to the Y-electrode lines $Y_1, \ldots, Y_n$ and the address electrode lines $A_{R1}$, $A_{G1}$, . . . , $A_{Gm}$, $A_{Bm}$.

Next, a voltage applied to the Y-electrode lines $Y_1, \ldots, Y_n$ is raised from a second voltage $V_S$ (e.g., 155 V) to a maximum voltage ($V_{SET}+V_S$) (e.g., 355 V), and simultaneously, a ground voltage $V_G$ is applied to the X-electrode lines $X_1$, . . . , $X_n$ and the address electrode lines $A_{R1}$, $A_{G1}$, . . . , $A_{Gm}$, $A_{Bm}$.

Next, while a voltage applied to the X-electrode lines $X_1, \ldots, X_n$ is maintained at the second voltage $V_S$, a voltage applied to the Y-electrode lines $Y_1, \ldots, Y_n$ reduces from the second voltage $V_S$ to the ground voltage $V_G$ while simultaneously applying a ground voltage $V_G$ to the address electrode lines $A_{R1}$, $A_{G1}$, . . . , $A_{Gm}$, $A_{Bm}$.

Thus, during the address period PA, while applying display data signals to the address electrode lines $A_{R1}$, $A_{G1}, \ldots, A_{Gm}, A_{Bm}$, a scan signal of the ground voltage $V_G$ is sequentially applied to the Y-electrode lines $Y_1, \ldots, Y_n$, which are biased to a fourth voltage $V_{SCAN}$, to thereby address the Y-electrode lines $Y_1, \ldots, Y_n$. Applying display data signals of an address voltage $V_A$ to the address electrode lines $A_{R1}$, $A_{G1}$, . . . , $A_{Gm}$, $A_{Bm}$ selects the respective discharge cell, and a ground voltage $V_G$ is applied to an address electrode line when the corresponding discharge cell is not to be selected. Thus, applying an address voltage $V_A$ to an address electrode while applying the ground voltage $V_G$ to the corresponding Y electroce generates wall charges in corresponding discharge cell due to an address discharge.

To facilitate the address discharge, the first voltage Ve may be maintained at the X-electrode lines $X_1, \ldots, X_n$ during the address period.

During the sustain period PS, a sustain pulse of a second voltage $V_S$ is alternately applied to the Y-electrode lines $Y_1, \ldots, Y_n$ and the X-electrode lines $X_1, \ldots, X_n$, thereby provoking a display discharge in those discharge cells that were selected during the address period PA.

FIG. 6 is a circuit diagram of a Y-driver of a conventional apparatus for driving a PDP, FIG. 7 is a timing chart showing examples of scan controlling signals applied to a scan drive integrated circuit (IC), and FIG. 8 is a timing chart showing examples of scan controlling signals used in a conventional method of driving a PDP.

Referring to FIG. 6, a Y-driver 25 processes Y drive controlling signals $S_Y$ to generate a display data signal and applies it to the Y-electrode lines. The Y-driver 25 may include a circuit portion and a scan drive IC 251. The circuit portion applies various voltages (e.g., $V_s$, $V_{set}$, or $V_{scan}$) to the Y-electrode lines in the reset period PR, address period PA, and sustain period PS. The scan drive IC 251 enables sequential application of a scan pulse to the Y-electrode lines during the address period PA.

The scan drive IC 251 may include a plurality of output terminals and one scan drive IC may be formed for each Y-electrode line.

The scan drive IC 251 receives scan controlling signals as shown in FIG. 7 and outputs a scan pulse to the Y-electrode lines during the address period. Although the scan controlling signals may be changed depending on the type of the scan drive IC 251, they typically include a clock signal CLK, a data signal Data, a strobe signal STB, a blanking signal BLK, and a high impedance controlling signal HIZ.

The scan drive IC 251 outputs a scan pulse to the Y-electrode lines during the address period PA, and a discharge pulse and a reset pulse may pass through its internal diode path during the sustain period PS and reset period PR. Accordingly, as shown in FIG. 8, the scan drive IC 251 may be grounded at a floating electric potential level, which varies over time, instead of an absolute "0" level. A device for electrically isolating an input controlling signal of the scan drive IC 251 from its output controlling signal may be required to provide such a floating ground.

Conventionally, an optocoupler or a transformer may be used to electrically isolate the scan drive's input signal from the output signal. A typical apparatus for driving a PDP utilizes an optocoupler 252, as shown in FIG. 6. However, when producing PDPs in bulk, providing the optocoupler 252 may increases dispersion of components and defective products, thereby reducing yield.

SUMMARY OF THE INVENTION

The present invention provides a method and apparatus for driving a PDP that does not require an isolating device in a scan drive integrated circuit.

Additional features of the invention will be set forth in the description which follows, and in part will be apparent from the description, or may be learned by practice of the invention.

The present invention discloses a method of driving a PDP in which X-electrode lines, Y-electrode lines and address electrode lines define discharge cells, and in which a unit frame as a display period is divided into a plurality of subfields to realize time-division grayscale display, and the individual subfields include a reset period, an address period, and a sustain period. The method comprises maintain the Y-electrode lines at a reference level during the reset period and the sustain period. During the address period, the Y-electrode lines are addressed by biasing the Y-electrode lines to a first level and simultaneously, a scan signal of the reference level is sequentially applied to the Y-electrode lines.

The present invention also discloses a method of driving a PDP in which X-electrode lines, Y-electrode lines and address electrode lines define discharge cells, and in which a unit frame as a display period is divided into a plurality of subfields to realize time-division grayscale display, and the individual subfields include a reset period, an address period, and a sustain period. The method comprises during the reset period, maintaining the Y-electrode lines at a first level in a first part of the reset period and at a reference level in a second part of the reset period. During the address periods, the Y-electrode lines are biased to the first level and simultaneously, a scan signal of the reference level is sequentially applied to address the Y-electrode lines. During the sustain period, a Y sustain pulse of the first level is applied to the Y-electrode lines.

The present invention also discloses an apparatus for driving a PDP in which X-electrode lines, Y-electrode lines and address electrodes define discharge cells, and in which a unit frame as a display period is divided into a plurality of subfields to realize time-division grayscale display, and the individual subfields include a reset period, an address period, and a sustain period. A controller generates a scan controlling signal, an address controlling signal, a reset/sustain controlling signal, and a common controlling signal. A Y-driver applies a scan drive signal to the Y-electrode lines in response to the scan controlling signal. An address driver applies an address drive signal to the address electrode lines in response to the address controlling signal. A reset/sustain circuit applies a reset/sustain drive signal to the X-electrode lines in response to the reset/sustain controlling signal. An X-driver applies a common drive signal to the X-electrode lines in response to the common controlling signal It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

The following describes exemplary embodiments of the present invention with reference to the attached drawings.

Figure 9:
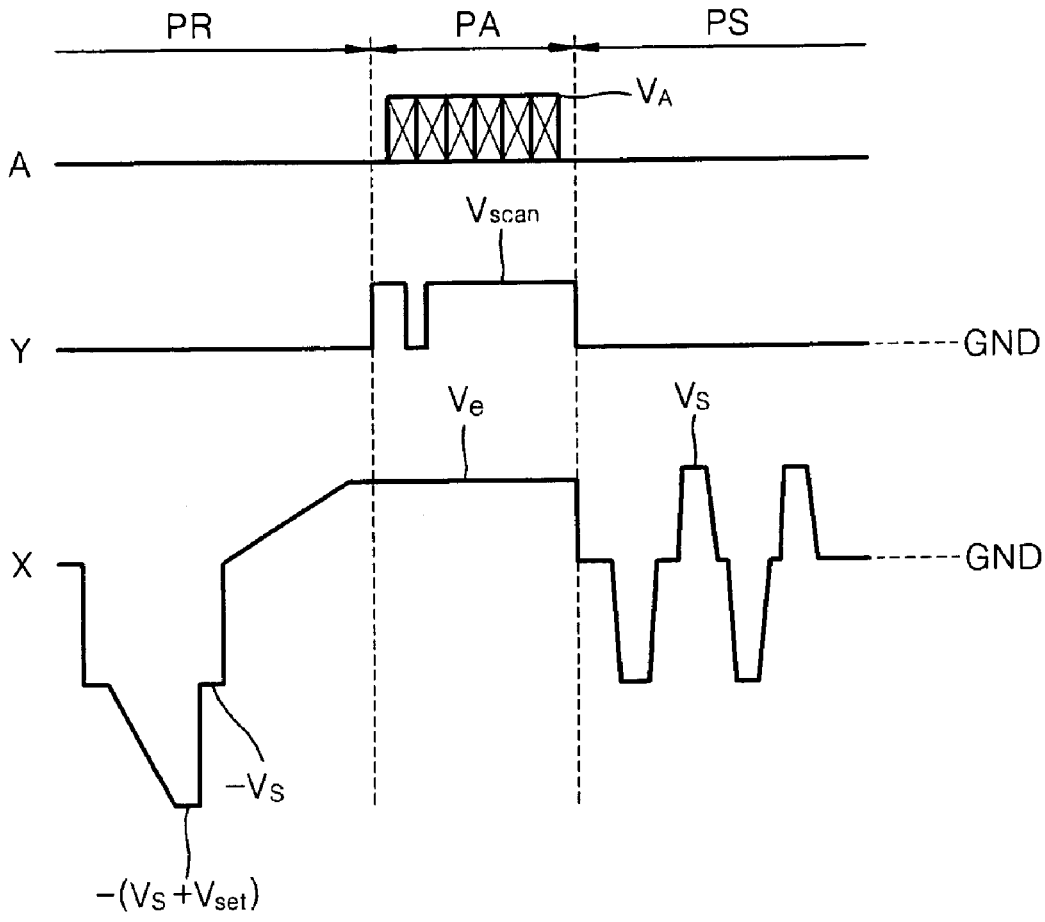
FIG. 9 is a timing chart showing a method of driving a PDP according to an exemplary embodiment of the present invention.
Figure 13:
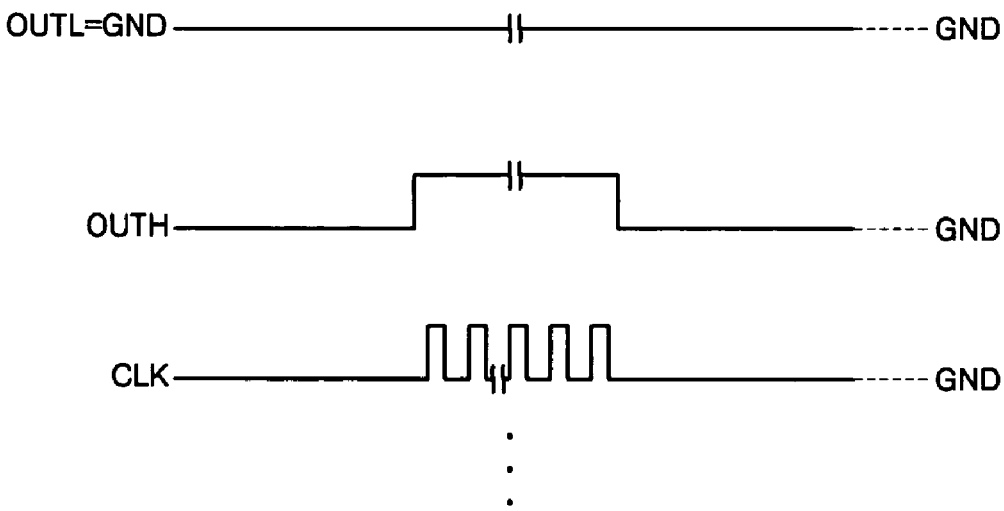
FIG. 13 is a timing chart showing examples of a scan drive signal used in the method according to exemplary embodiments of the present invention.

FIG. 9 is a timing chart showing a method of driving a PDP according to an exemplary embodiment of the present invention, and FIG. 13 is a timing chart showing examples of a scan drive signal used in the method according to the present invention.

Referring to FIG. 9, the Y-electrode lines $Y_1, \ldots, Y_n$ are maintained at a reference level GND during the reset period PR and the sustain period PS. During the address period PA, the Y-electrode lines $Y_1, \ldots, Y_n$ are biased to a first level $V_{scan}$ while a scan signal of the reference level GND is sequentially applied to them.

During the reset period PR, with the Y-electrode lines $Y_1, \ldots, Y_n$ at the reference level GND, the address electrode lines $A_{R1}, A_{G1}, \ldots, A_{Gm}, A_{Bm}$ are also maintained at the reference level GND, and a falling ramp pulse that falls from a level $-V_s$ to a level $-(V_s+V_{set})$ is applied to the X-electrode lines $X_1, \ldots, X_n$, and then a rising ramp pulse that rises from the reference level GND to a level $V_e$ is applied to the X-electrode lines $X_1, \ldots, X_n$.

During the address period PA, the X-electrode lines $X_1, \ldots, X_n$ are maintained at the level $V_e$, and the Y-electrode lines $Y_1, \ldots, Y_n$ are biased to the level $V_{scan}$. A signal of the reference level GND is sequentially applied to the Y-electrode lines $Y_1, \ldots, Y_n$ to address the Y-electrode lines $Y_1, \ldots, Y_n$, and an address voltage $V_A$ is applied to address electrode lines $A_{R1}, A_{G1}, \ldots, A_{Gm}, A_{Bm}$ of the discharge cells to be displayed. The address electrode lines are synchronized with the scan signal that is applied to the Y-electrode lines $Y_1, \ldots, Y_n$.

During the sustain period PS, a positive sustain pulse and a negative sustain pulse, each having a voltage at the level $V_s$, are alternately applied to the X-electrode lines $X_1, \ldots, X_n$ while the Y-electrode lines $Y_1, \ldots, Y_n$ and the address electrode lines $A_{R1}, A_{G1}, \ldots, A_{Gm}, A_{Bm}$ are also maintained at the reference level GND.

Consequently, according to the first exemplary embodiment of the present invention, the scan pulses are applied to the Y-electrode lines $Y_1, \ldots, Y_n$, and the sustain pulses and the reset pulses are applied to the X-electrode lines $X_1, \ldots, X_n$.

Therefore, in the method of driving a PDP according to the first exemplary embodiment, the scan drive IC for the Y electrodes only needs to generate a scan pulse. Hence, a circuit portion for generating reset discharges and sustain discharges is not necessary. Accordingly, unlike a conventional PDP driving apparatus, the scan drive IC uses an absolute ground instead of a floating ground. Therefore, an isolating device for electrically isolating the scan drive IC to generate a floating ground is not required.

As a result, an optocoupler (252 of FIG. 6), which is typically used as the isolating device for a typical PDP driving apparatus, is not needed, which may increase yield when mass producing PDPs.

Further, since the scan drive IC may use the absolute ground instead of the floating ground, even the scan controlling signal applied to the scan drive IC may have a signal level required only for address periods on the basis of the absolute ground GND.

Figure 8:
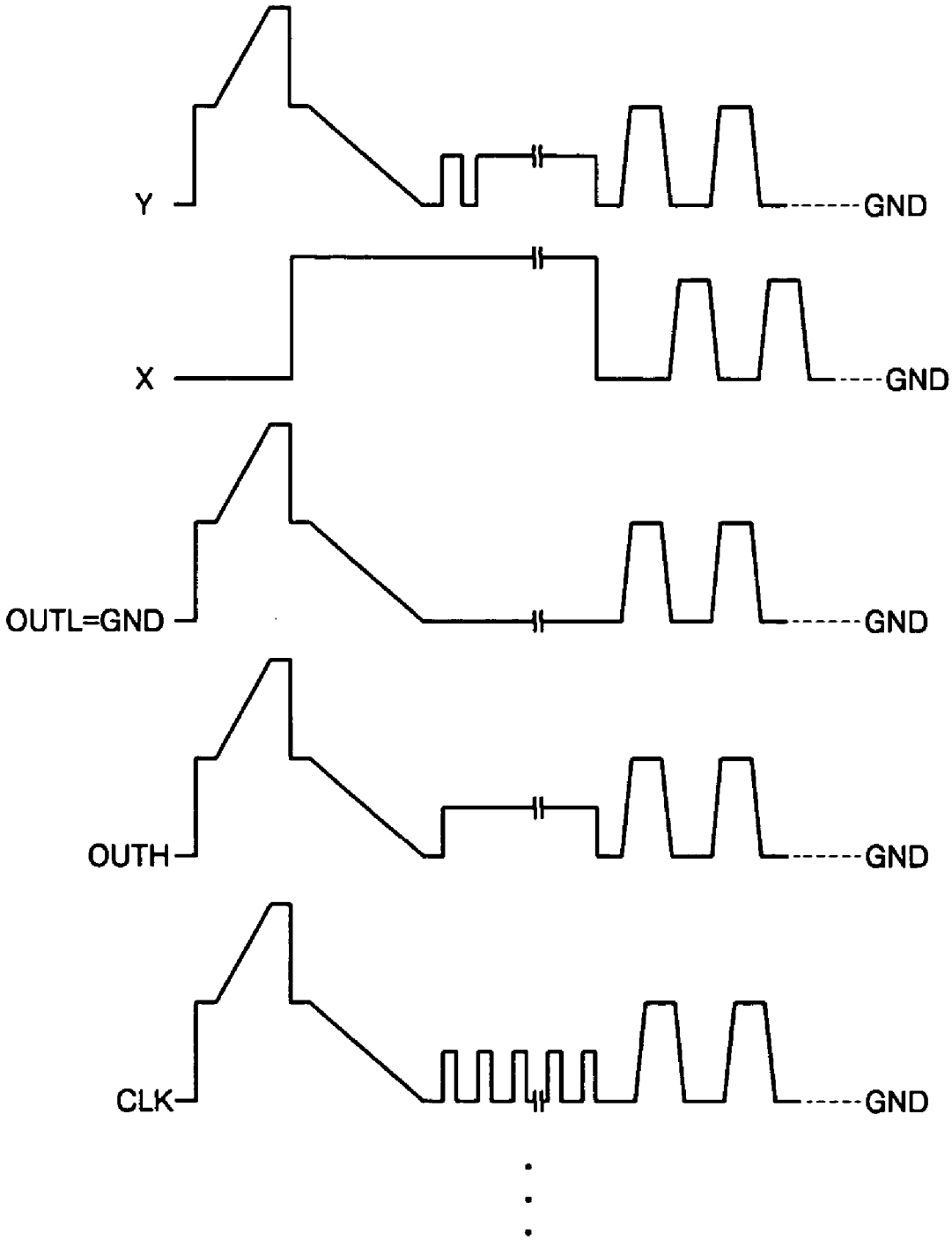
FIG. 8 (PRIOR ART)
FIG. 8 is a timing chart showing examples of scan controlling signals used in a conventional method of driving a PDP.

FIG. 13 shows examples of scan controlling signals, which are applied on the basis of an absolute ground instead of a floating ground, according to the first exemplary embodiment of the present invention. As compared to FIG. 8, a low-level signal OUTL, a high-level signal OUTH and a clock signal CLK having levels of an absolute ground GND.

Figure 10:
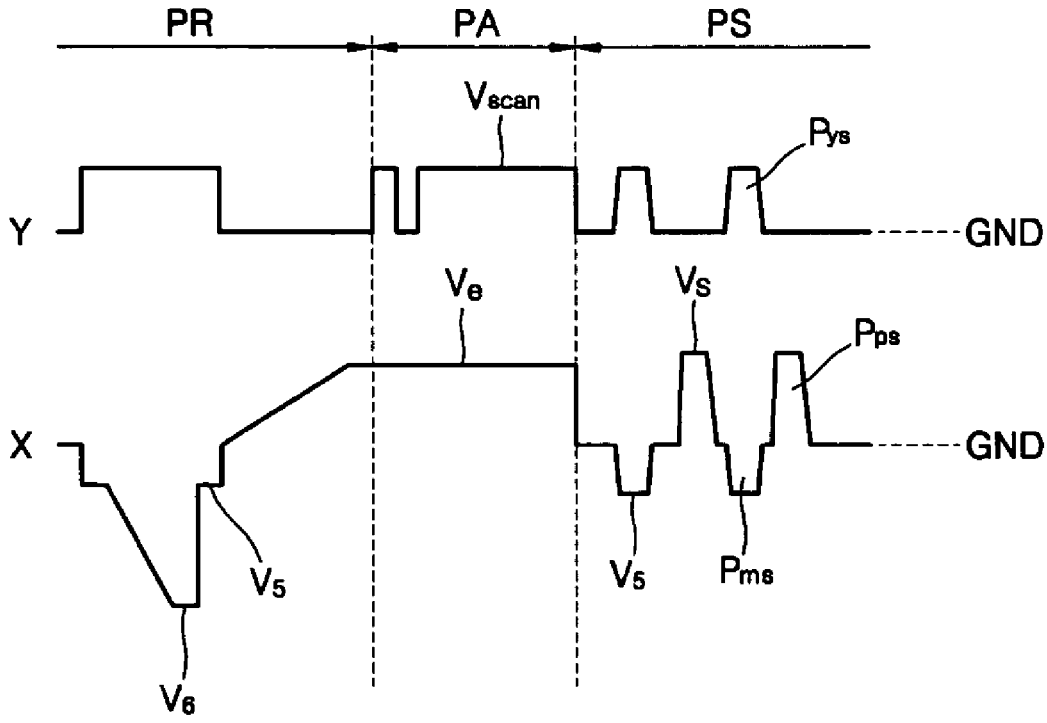
FIG. 10 is a timing chart showing a method of driving a PDP according to a second exemplary embodiment of the present invention.

FIG. 10 is a timing chart showing a method of driving a PDP according to a second exemplary embodiment of the present invention.

Unlike the first exemplary embodiment, as shown in FIG. 10, a reset pulse and a sustain pulse may be applied to the Y electrodes $Y_1, \ldots, Y_n$. In a first part of the reset period PR, the Y-electrode lines $Y_1, \ldots, Y_n$ are biased to a level $V_{scan}$ on the basis of a reference level GND, and they are maintained at the reference level GND during a second part of the reset period PR. During the address period PA, the Y-electrode lines $Y_1, \ldots, Y_n$ are biased to the level $V_{scan}$, and a scan signal of the reference level GND is sequentially applied to them. During the sustain period PS, a Y sustain pulse $P_{ys}$ of the level $V_{scan}$ is applied to the Y-electrode lines $Y_1, \ldots, Y_n$.

In the first part of the reset period PR, a falling ramp pulse that falls from a level $V_5$ to a level $V_6$ is applied to the X-electrode lines $X_1, \ldots, X_n$, and then a rising ramp pulse that rises from the reference level GND to a level $V_e$ is applied thereto in the second part. The address electrode lines $A_{R1}, A_{G1}, \ldots, A_{Gm}, A_{Bm}$ (not shown) are maintained at the reference level GND in the reset period PR.

The address period PA of the second exemplary embodiment is carried out similar to the address period PA of the first exemplary embodiment; hence, it is not discussed further here.

During the sustain period PS, a positive sustain pulse $P_{ps}$, which has a level $V_s$ on the basis of the reference level GND, and a negative sustain pulse $P_{ms}$, which has a level $V_5$ on the basis of the reference level GND, are alternately applied to the X-electrode lines $X_1, \ldots, X_n$. Also, a Y sustain pulse $P_{ys}$, having the level $V_{scan}$ on the basis of the reference level GND, is applied to the Y-electrode lines $Y_1, \ldots, Y_n$. The address electrode lines $A_{R1}, AG_1, \ldots, A_{Gm}, A_{Bm}$ (not shown) are maintained at the reference level GND.

Preferably, the Y sustain pulse $P_{ys}$ is applied to the Y-electrode lines $Y_1, \ldots, Y_n$ at the same time that the negative sustain pulse $P_{ms}$ is applied to the X-electrode lines $X_1, \ldots, X_n$. In other words, it is preferable that a difference between the level of the Y sustain pulse $P_{ys}$ and the level of the negative sustain pulse $P_{ms}$ equals a voltage $V_S$, which is a typical value for a conventional sustain pulse.

Accordingly, the level $V_5$ preferably corresponds to a difference between the level $V_{scan}$ and the level $V_s$. In this case, an electrical relationship between the X-electrodes and the Y-electrodes during the first reset period may be the same as in the conventional case.

Since the second exemplary embodiment as described with reference to FIG. 10 performs the same function as the first exemplary embodiment as described with reference to FIG. 9, a detailed description thereof is not repeated here.

Figure 11:
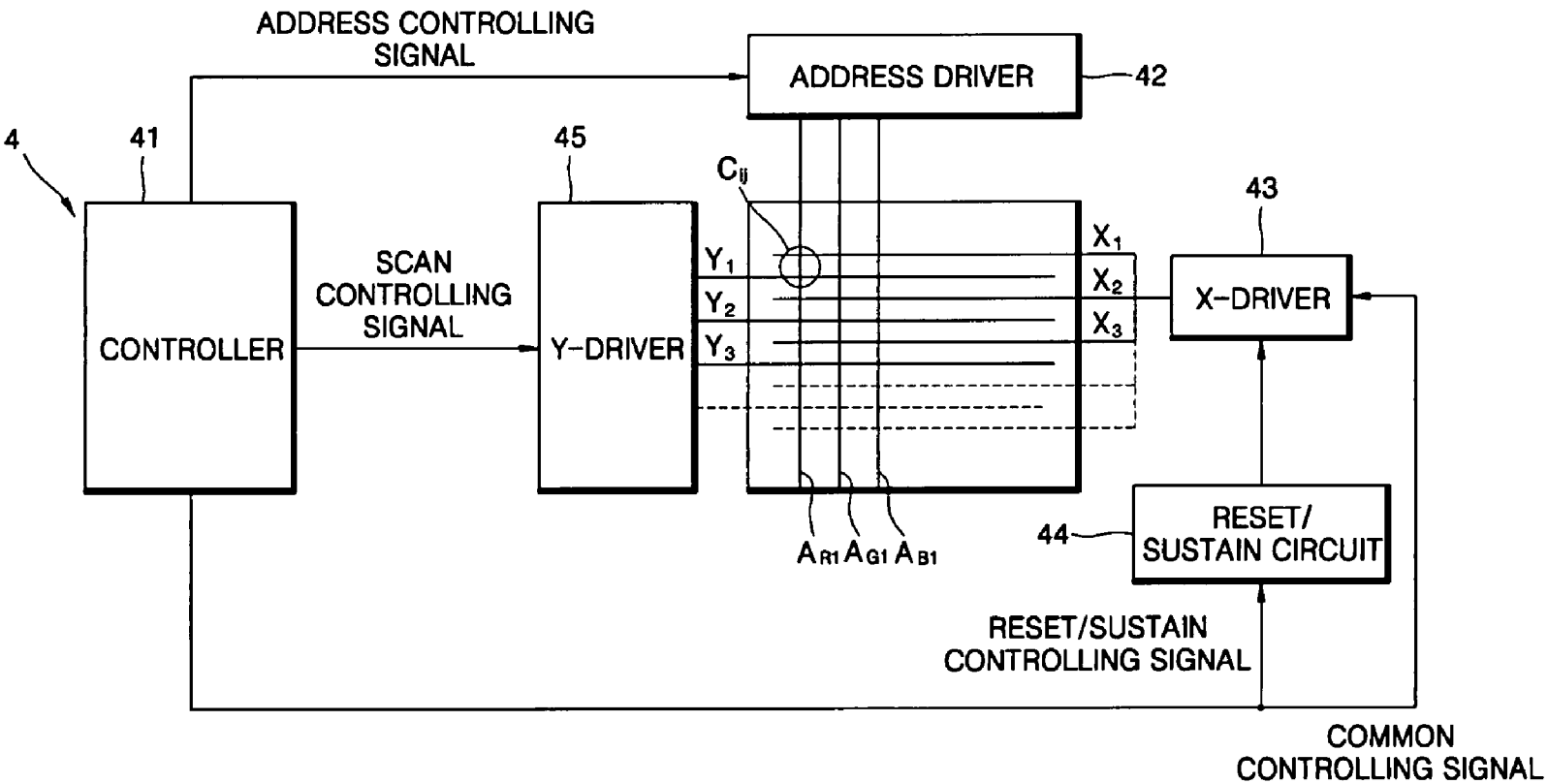
FIG. 11 is a block diagram showing a PDP driving apparatus according to an exemplary embodiment of the present invention.
Figure 12:
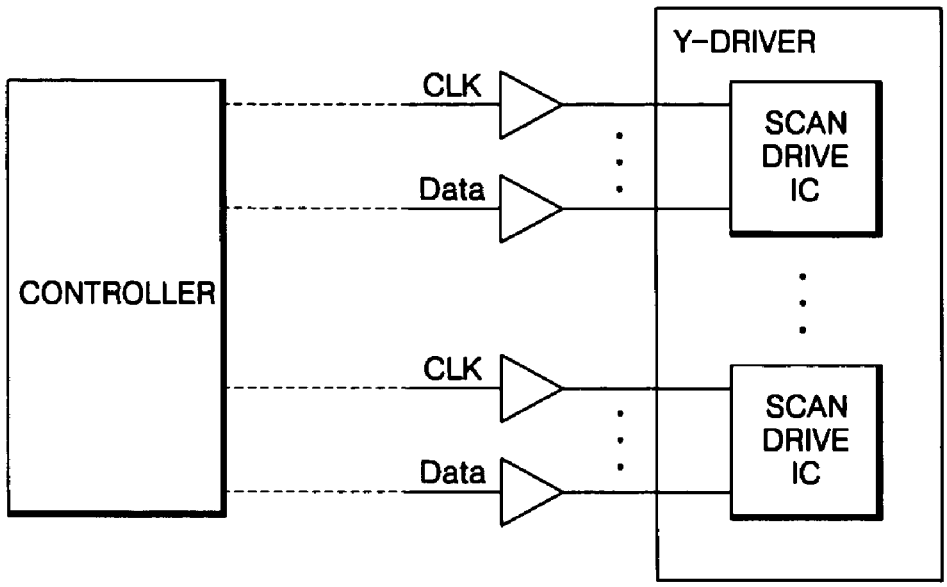
FIG. 12 is a block diagram showing a scan driver of the apparatus shown in FIG. 11.
Figure 14:
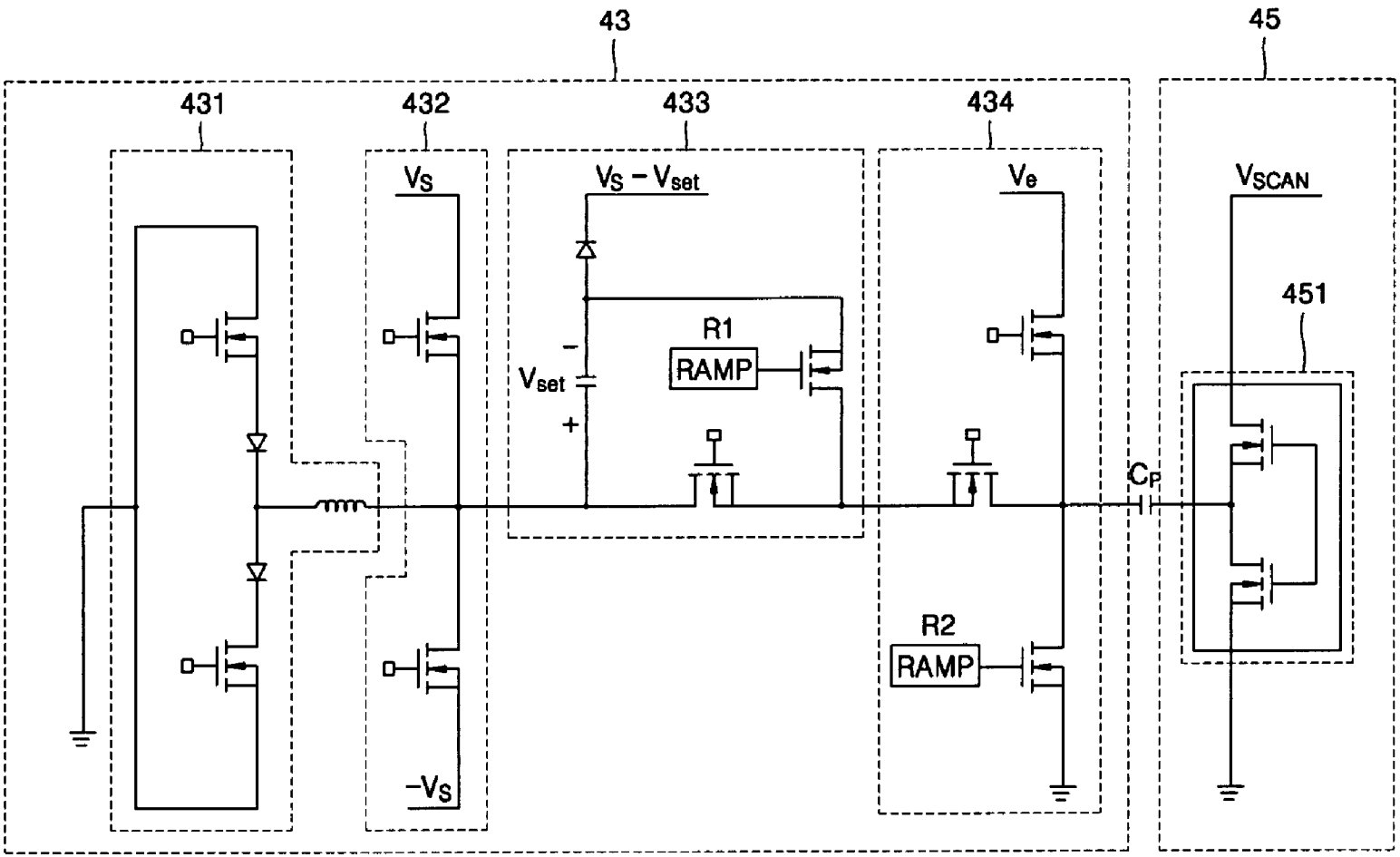
FIG. 14 is a circuit diagram showing an X-driver and a Y-driver of the PDP shown in FIG. 11.

FIG. 11 is a block diagram showing an apparatus for driving a PDP according to an exemplary embodiment of the present invention, FIG. 12 is a block diagram showing a scan driver of the apparatus shown in FIG. 11, and FIG. 14 is a circuit diagram showing an X-driver and a Y-driver of the PDP shown in FIG. 11.

Referring to FIG. 11, an apparatus 4 for driving a PDP includes a controller 41, a Y-driver 45, an address driver 42, a reset/sustain circuit 44, and an X-driver 43. Parallel pairs of sustain electrode lines, comprising the X-electrode lines $X_1, \ldots, X_n$ and Y-electrode lines $Y_1, \ldots, Y_n$ are alternately arranged and are disposed to be orthogonal to address electrode lines $A_{R1}, A_{G1}, A_{B1} \ldots$ Intersections between the sustain electrode lines and the address electrode lines define discharge cells $C_{ij}$.

The controller 41 processes input image data to generate a scan controlling signal, an address controlling signal, a reset/sustain controlling signal, and a common controlling signal. The Y-driver 45 applies a scan drive signal to the Y-electrode lines $Y_1, \ldots, Y_n$ in response to the scan controlling signal. The address driver 42 applies an address drive signal to the address electrode lines $A_{R1}$, $A_{G1}$, $A_{B1} \ldots$ in response to an address controlling signal. The reset/sustain circuit 44 applies a reset/sustain drive signal to the X-electrode lines $X_1, \ldots, X_n$ in response to the reset/sustain controlling signal, and the X-driver 43 applies a common drive signal to the X-electrode lines $X_1, \ldots, X_n$ in response to the common controlling signal.

The Y-driver 45 may include a scan driver that applies a scan pulse to the Y-electrode lines $Y_1, \ldots, Y_n$ in order to address the Y-electrode lines $Y_1, \ldots, Y_n$ during the address period PA.

Here, the scan controlling signal output from the controller 41 is not electrically isolated, and it may be directly input to the scan driver. As shown in FIG. 14, a ground connected to the scan driver 451 may be an absolute ground GND. Also, the scan controlling signal may be maintained at a ground level GND during each the reset period PR and the sustain period PS.

The X-driver 43 may provide a reset pulse and a sustain pulse to the X-electrode lines $X_1, \ldots, X_n$ during the reset period PR and the sustain period PS, as well as bias the X-electrode lines $X_1, \ldots, X_n$ to a level $V_e$ on the basis of the reference level GND during the address period PA.

Accordingly, as shown in FIG. 14, an apparatus for driving a PDP may include a panel capacitor $C_P$, which has one terminal connected to an X-driver 43 and the other terminal connected to a Y-driver 45.

The X-driver 43 may include an energy retriever 431, a sustain voltage generator 432, a reset circuit 433, and a bias voltage generator 434. The Y-driver 45 may include a scan driver 451 that applies a scan voltage $V_{scan}$ to Y-electrode lines.

The energy retriever 431 retrieves and charges charge/discharge energy to the panel capacitor $C_P$. The sustain voltage generator 432 applies a positive sustain voltage $V_S$ and a negative sustain voltage $-V_s$ to X-electrode lines. The reset circuit 433 applies a reset voltage to the X-electrode lines and may include a negative ramp voltage generator $R_1$. The bias voltage generator 434 applies a bias voltage to the X-electrode lines during the address period and may include a ramp voltage generator $R_2$ for applying the bias voltage.

Figure 1:
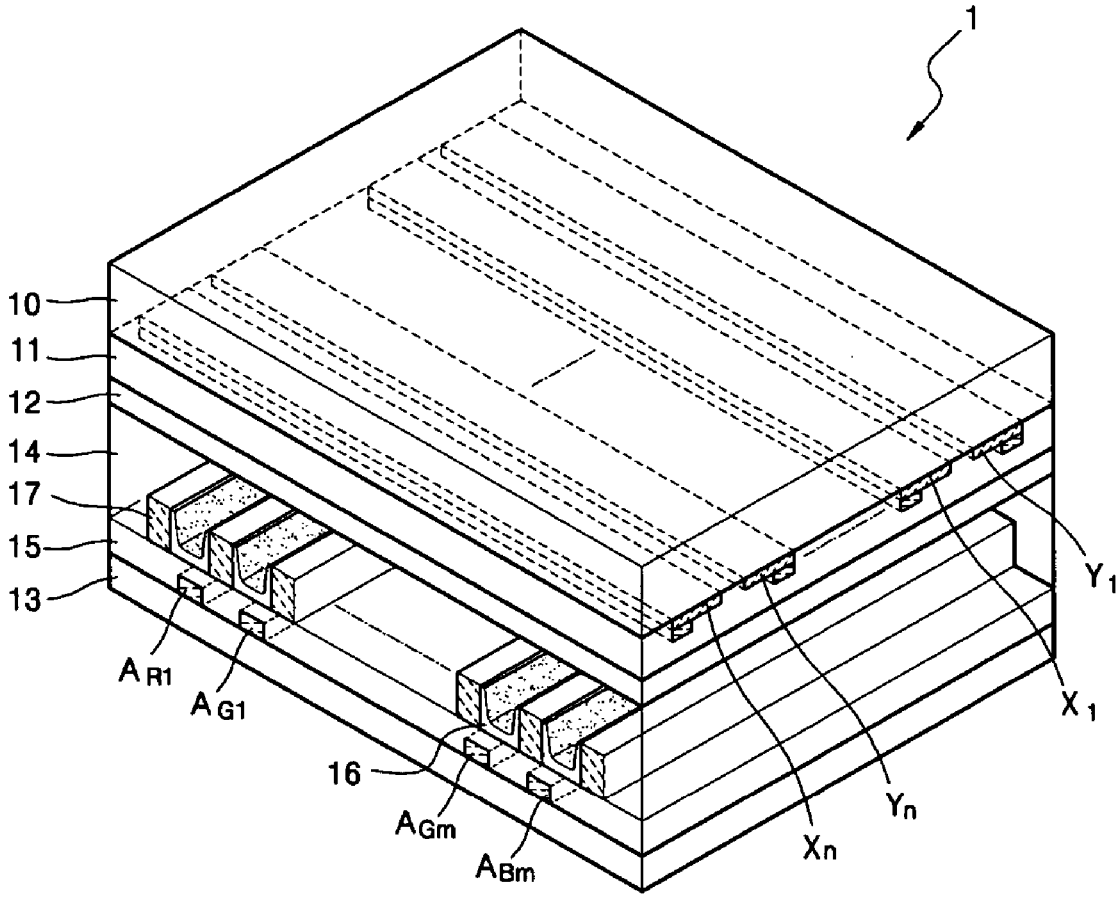
FIG. 1 (PRIOR ART)
FIG. 1 is an internal perspective view showing a structure of a typical surface discharge type triode PDP.
Figure 2:
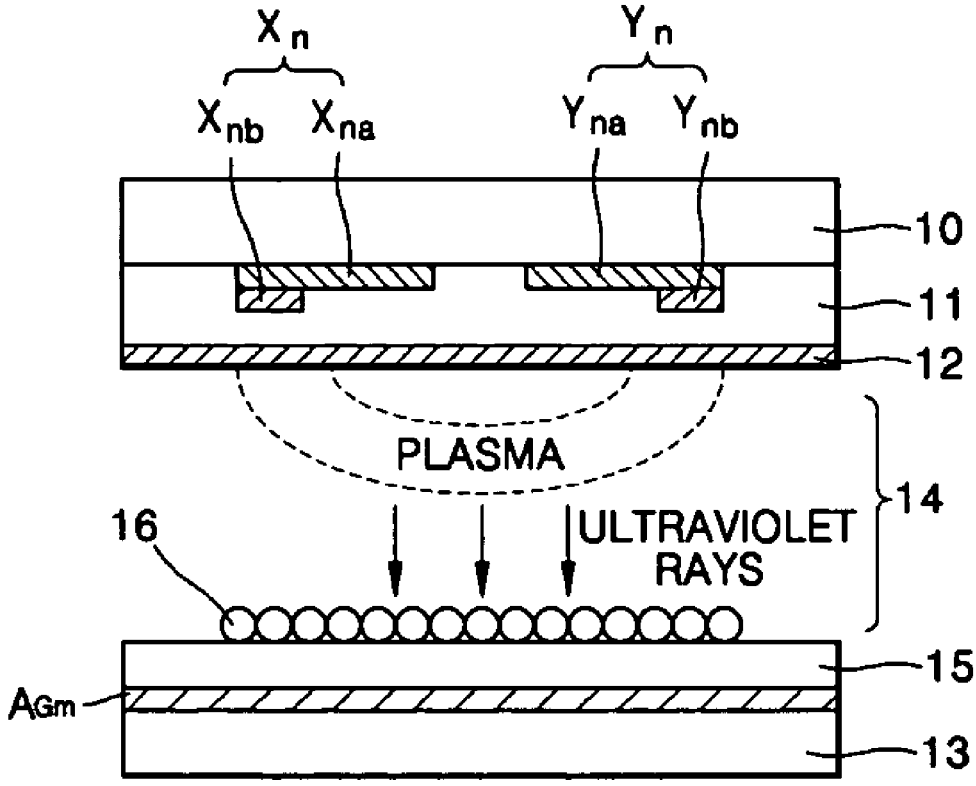
FIG. 2 (PRIOR ART)
FIG. 2 is a cross-sectional view showing a single discharge cell of the PDP of FIG. 1.
Figure 3:
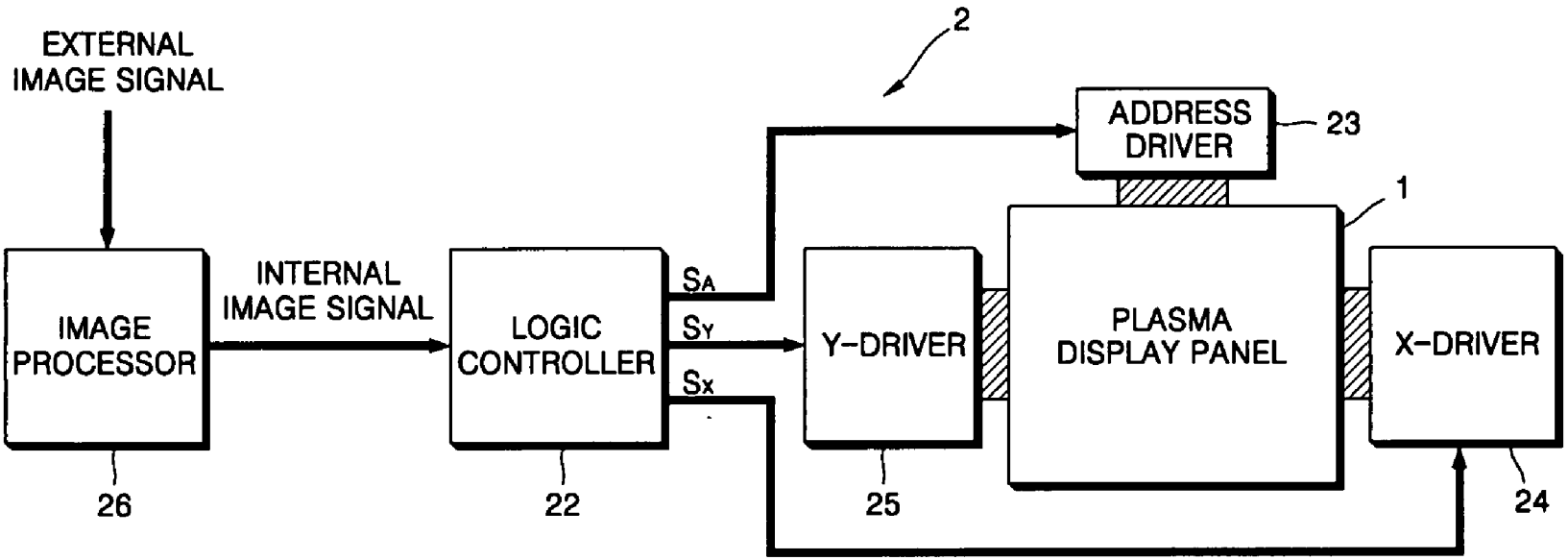
FIG. 3 (PRIOR ART)
FIG. 3 is a block diagram showing a typical driving apparatus for the PDP of FIG. 1.
Figure 4:
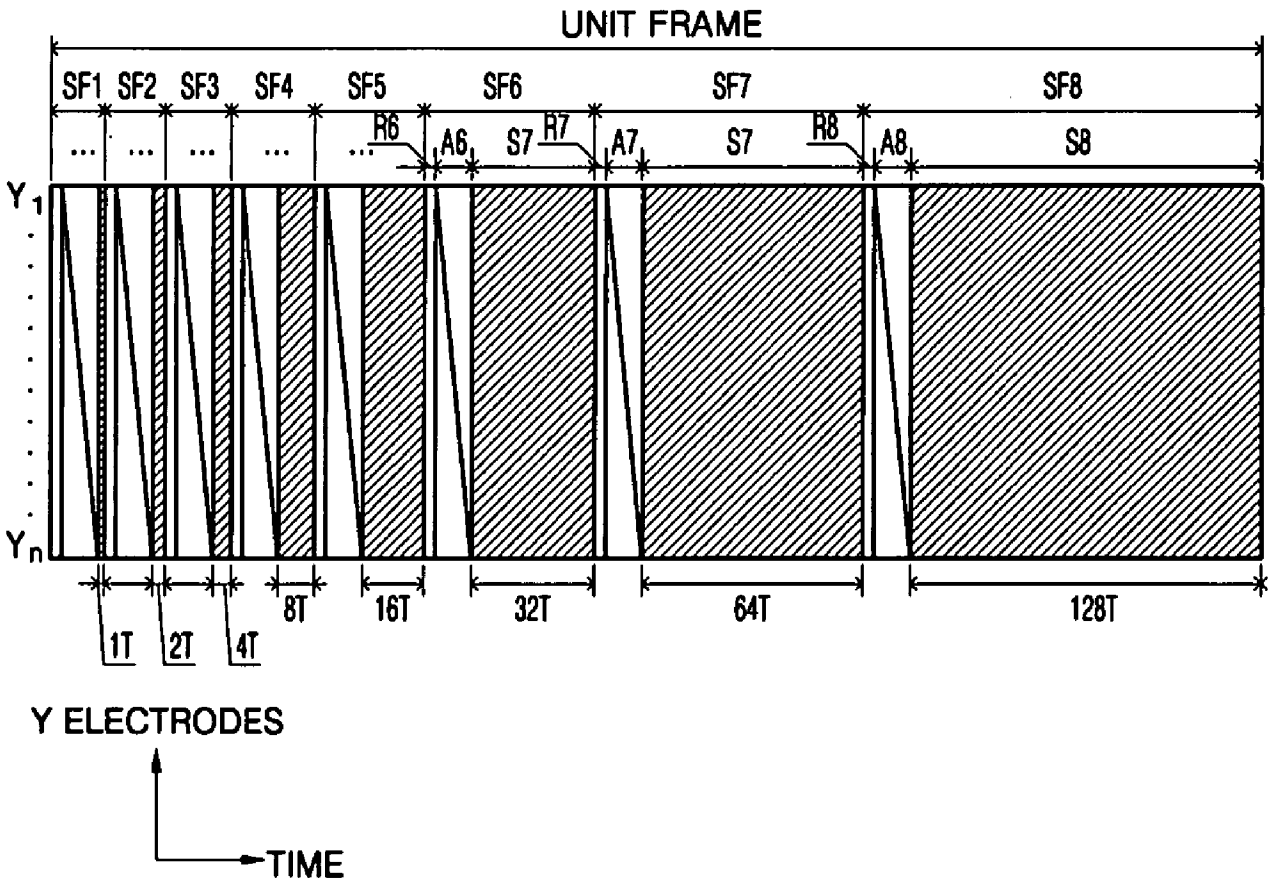
FIG. 4 (PRIOR ART)
FIG. 4 is a timing chart showing a typical method of driving the PDP of FIG. 1.
Figure 5:
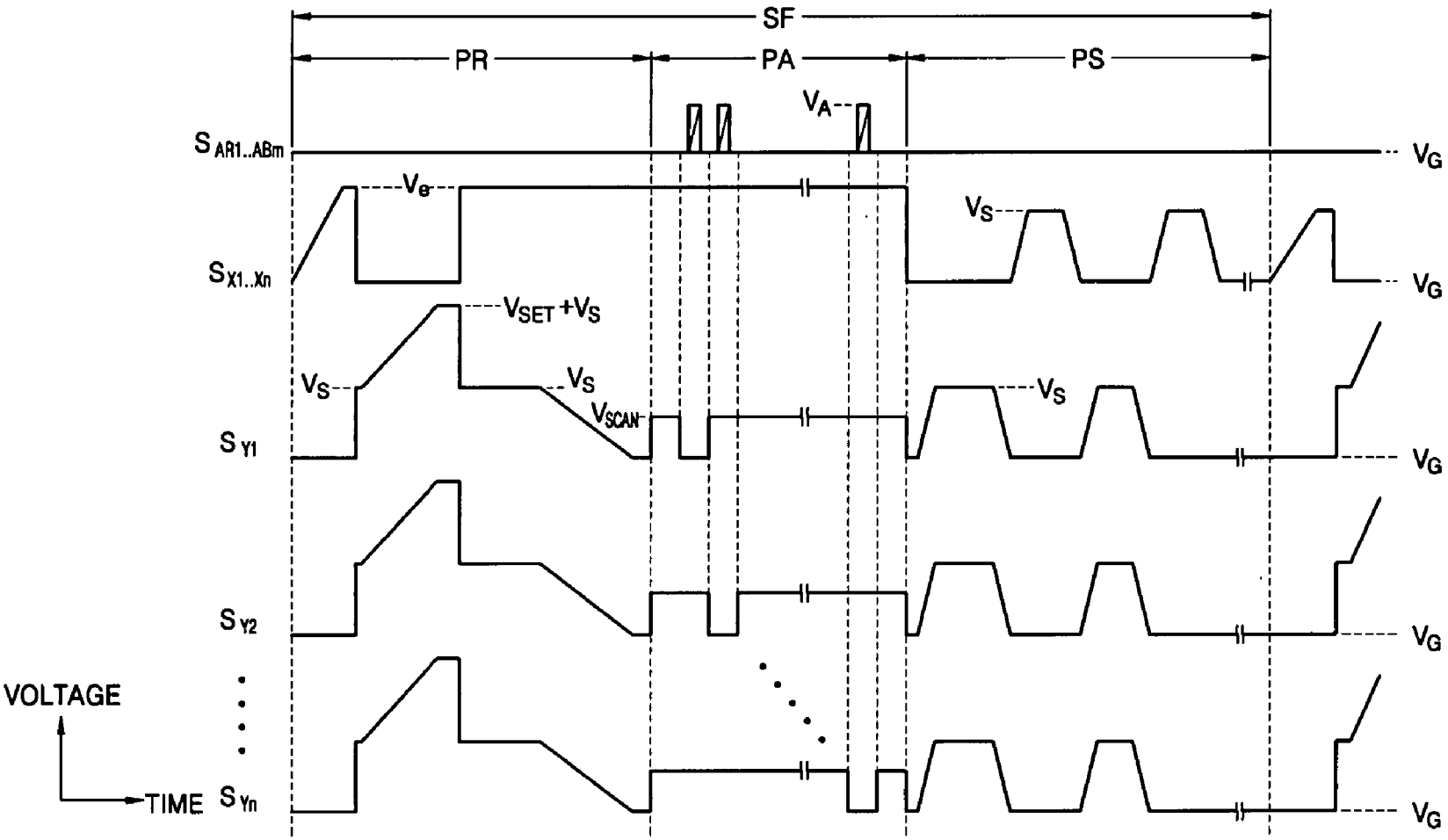
FIG. 5 (PRIOR ART)
FIG. 5 is a timing chart showing typical drive signals applied to electrode lines of the PDP of FIG. 1.
Figure 6:
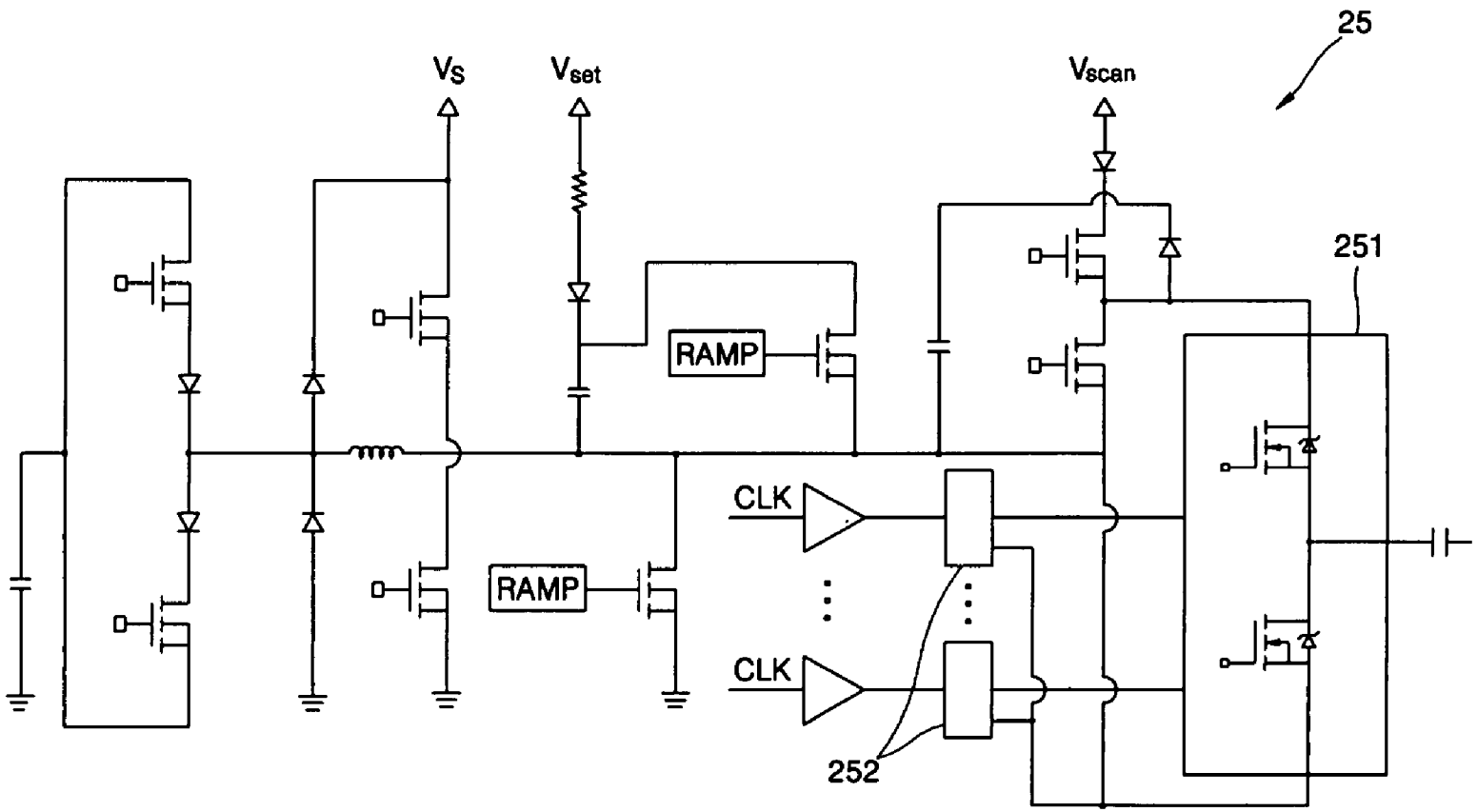
FIG. 6 (PRIOR ART)
FIG. 6 is a circuit diagram showing a conventional Y-driver for a PDP.
Figure 7:
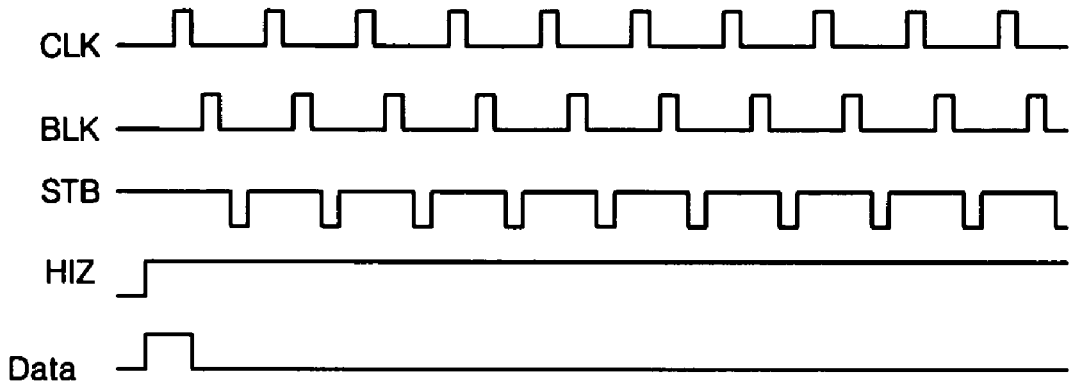
FIG. 7 (PRIOR ART)
FIG. 7 is a timing chart showing examples of scan controlling signals applied to a scan drive integrated circuit (IC) during scan drive in the apparatus shown in FIG. 6.

A conventional apparatus for driving a PDP may employ the Y-driver 25 shown in FIG. 6 to apply a voltage having the waveform shown in FIG. 5 to respective electrode lines. The conventional Y-driver 25 may include a sustain voltage generator, a reset circuit including a ramp, and a bias voltage generator. However, as shown in FIG. 14, according to an exemplary embodiment of the present invention, the X-driver 43 includes the energy retriever 431, the sustain voltage generator 432, the reset circuit 433, and the bias voltage generator 434 in order to apply a voltage having the waveform shown in FIG. 9 or 10 to respective electrode lines.

As noted above, the conventional apparatus for driving a PDP may require an optocoupler capable of using a floating ground in order to apply a scan pulse, a sustain voltage, a reset voltage, and a bias voltage to a Y electrode line.

However, in the apparatus according to exemplary embodiments of the present invention, the Y-driver 45 includes the scan driver 451 for applying a scan pulse to the Y-electrodes, while the X-driver 43 includes the energy retriever 431, the sustain voltage generator 432, the reset circuit 433, and the bias voltage generator 434. Thus, an optocoupler is not required.

Since the apparatus of the present invention drives a PDP according to the PDP driving method illustrated in FIG. 9 or FIG. 10, a detailed description of its function and effect is omitted here.

As explained thus far, the present invention does not require an isolating device, such as an optocoupler, which is conventionally used to electrically isolate a scan controlling signal applied to a scan drive IC. Hence, the scan electrode driving circuitry may be simplified.

Also, the present invention solves problems that may be caused by a failure of an isolating device such as an optocoupler, which may often occur when PDPs are conventionally produced in bulk, thus greatly increasing yield.

Further, when only a scan discharge is performed in scan electrodes, and not a reset or sustain discharge, a driver board integrating X-electrodes and Y-electrodes may be easily designed.

Also, because an isolating device, such as an optocoupler, which accounts for a large portion of a PDP's production cost is not needed, the production cost may be reduced.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A method for driving a plasma display panel in which X-electrode lines, Y-electrode lines and address electrode lines define discharge cells, and in which a unit frame as a display period is divided into a plurality of subfields to realize time-division grayscale display, the method comprising:

dividing a subfield into a reset period, an address period, and a sustain period;

maintaining the Y-electrode lines at a reference level during the reset period and the sustain period; and biasing the Y-electrode lines to a first level and applying a sequential scan signal of the reference level to the Y-electrode lines during the address period.

2. The method of claim 1, further comprising:
during the reset period,
applying a falling ramp pulse that falls from a second level to a third level and then a rising ramp pulse that rises from the reference level to a fourth level to the X-electrode lines.

3. The method of claim 2, further comprising:
during the address period,
maintaining the X-electrode lines at the fourth level.

4. The method of claim 1, further comprising:
during the sustain period,
alternately applying a positive sustain pulse having a second level and a negative sustain pulse having the second level to the X-electrode lines.

5. The method of claim 1, wherein the reference level is a ground voltage.

6. A method for driving a plasma display panel in which X-electrode lines, Y-electrode lines and address electrode lines define discharge cells, and in which a unit frame as a display period is divided into a plurality of subfields to realize time-division grayscale display, the method comprising:
dividing a subfield into a reset period, an address period, and a sustain period;
biasing the Y-electrode lines to a first level in a first part of the reset period and maintaining the Y-electrode lines at a reference level in a second part of the reset period;
biasing the Y-electrode lines to the first level and applying a sequential scan signal of the reference level to the Y-electrode lines during the address period; and
applying a Y sustain pulse of the first level to the Y-electrode lines during the sustain period.

7. The method of claim 6, further comprising:
during a reset period,
applying a falling ramp pulse that falls from a second level to a third level and a rising ramp pulse that rises from the reference level to a fourth level to the X-electrode lines.

8. The method of claim 7, wherein the falling ramp pulse is applied during the first part of the reset period, and the rising ramp pulse is applied during the second part of the reset period.

9. The method of claim 7, further comprising:
maintaining the X-electrode lines at the fourth level during the address period.

10. The method of claim 7, further comprising:
during the sustain period,
alternately applying a positive sustain pulse of a fifth level and a negative sustain pulse of the second level to the X-electrode lines.

11. The method of claim 10, wherein the Y sustain pulse is applied to the Y-electrode lines at the same time that the negative sustain pulse is applied to the X-electrode lines.

12. The method of claim 7, wherein the second level corresponds to a difference between the first level applied to the Y-electrode lines and the fifth level applied to the X-electrode lines.

13. The method of claim 6, wherein the reference level is a ground voltage.

14. An apparatus of driving a plasma display panel in which X-electrode lines, Y-electrode lines and address electrodes define discharge cells, and in which a unit frame as a display period is divided into a plurality of subfields to realize time-division grayscale display, and a subfield includes a reset period, an address period, and a sustain period, the apparatus comprising:
a controller to generate a scan controlling signal, an address controlling signal, a reset/sustain controlling signal, and a common controlling signal;
a Y-driver applying a scan drive signal to the Y-electrode lines in response to the scan controlling signal;
an address driver applying an address drive signal to the address electrode lines in response to the address controlling signal;
a reset/sustain circuit applying a reset/sustain drive signal to the X-electrode lines in response to the reset/sustain controlling signal; and
an X-driver applying a common drive signal to the X-electrode lines in response to the common controlling signal.

15. The apparatus of claim 14, wherein the Y-driver comprises a scan driver applying a scan pulse to the Y-electrode lines to address the Y-electrode lines during the address period.

16. The apparatus of claim 15, wherein the scan controlling signal output from the controller is electrically directly input to the scan driver.

17. The apparatus of claim 15, wherein a ground connected to the scan driver is an absolute ground.

18. The apparatus of claim 14, wherein the X-driver makes a reset pulse and a sustain pulse pass through the X-electrode lines during the reset period and the sustain period and biases the X-electrode lines to a first level during the address period.

19. The apparatus of claim 14, wherein the scan controlling signal is maintained at a ground level during the reset period and the sustain period.

* * * * *